US010612348B2

(12) United States Patent
Kamler et al.

(10) Patent No.: US 10,612,348 B2
(45) Date of Patent: Apr. 7, 2020

(54) METHOD AND DEVICE FOR SONOCHEMICAL TREATMENT OF WELL AND RESERVOIR

(71) Applicant: VENTORA TECHNOLOGIES AG, Hergiswil (CH)

(72) Inventors: Anna Vladimirovna Kamler, Moscow (RU); Manuel Kopp, Winfield (CA)

(73) Assignee: Ventora Technologies AG (CH)

( * ) Notice: Subject to any disclaimer, the term of this patent is extended or adjusted under 35 U.S.C. 154(b) by 0 days.

(21) Appl. No.: 15/750,735

(22) PCT Filed: Aug. 6, 2015

(86) PCT No.: PCT/RU2015/000493
§ 371 (c)(1),
(2) Date: Feb. 6, 2018

(87) PCT Pub. No.: WO2017/023186
PCT Pub. Date: Feb. 9, 2017

(65) Prior Publication Data

US 2019/0003288 A1 Jan. 3, 2019

(51) Int. Cl.
*E21B 43/00* (2006.01)
*E21B 43/25* (2006.01)
(Continued)

(52) U.S. Cl.
CPC ..... *E21B 43/003* (2013.01); *E21B 28/00* (2013.01); *E21B 43/16* (2013.01); *E21B 43/25* (2013.01)

(58) Field of Classification Search
None
See application file for complete search history.

(56) References Cited

U.S. PATENT DOCUMENTS 2,918,126 A * 12/1959 Bodine ..... E21B 37/00 166/177.1
3,422,894 A * 1/1969 Brandon ..... E21B 43/003 166/177.2
(Continued)

FOREIGN PATENT DOCUMENTS

EA 200970748 A1 12/2008
RU 2191896 C2 10/2002
(Continued)

OTHER PUBLICATIONS

Abramova, Anna, et al. "Ultrasonic technology for enhanced oil recovery." Engineering 6.04 (2014): 177.
(Continued)

*Primary Examiner* — Anuradha Ahuja
(74) *Attorney, Agent, or Firm* — Husch Blackwell LLP

(57) ABSTRACT

A method includes simultaneously injecting a chemical agent, through an injector, into a perforated wellbore section of a well in a hydrocarbon reservoir, and generating an acoustic wave with an acoustic tool in the wellbore section. The injector and acoustic tool are moved to and fro in synchronization. The acoustic tool includes at least one of a sonotrode and a shock wave tool. A downhole tool assembly comprises the injector, the acoustic tool, and a movable cable hose connected to the injector and the acoustic tool for moving the injector and acoustic tool to and fro in synchronization. The cable hose comprises a wire for supplying power to the acoustic tool and having a conduit for supplying the chemical agent to the injector.

22 Claims, 6 Drawing Sheets

(51) Int. Cl.
*E21B 43/16* (2006.01)
*E21B 28/00* (2006.01)

(56) References Cited

U.S. PATENT DOCUMENTS 3,730,269 A * 5/1973 Galle ..... E21B 28/00 166/177.2
4,252,189 A * 2/1981 Bodine ..... B01D 11/0261 166/177.6
4,366,988 A * 1/1983 Bodine ..... B01D 11/0261 166/177.1
5,824,214 A * 10/1998 Paul ..... C10G 15/08 208/107
6,227,293 B1 * 5/2001 Huffman ..... E21B 28/00 166/177.2
6,279,653 B1 * 8/2001 Wegener ..... E21B 28/00 166/177.2
7,059,403 B2 6/2006 Arnoldo Barrientos et al.
2005/0006088 A1 * 1/2005 Abramov ..... E21B 28/00 166/249
2006/0131012 A1 * 6/2006 Blauch ..... E21B 43/003 166/249
2008/0314595 A1 * 12/2008 Khomynets ..... E21B 43/124 166/308.2
2009/0016900 A1 * 1/2009 Khomynets ..... E21B 43/124 417/172
2011/0127031 A1 * 6/2011 Zolezzi Garreton ... E21B 28/00 166/249
2011/0168446 A1 7/2011 Lemenager et al.
2013/0000886 A1 * 1/2013 McGee ..... E21B 43/003 166/177.2
2013/0081807 A1 * 4/2013 Dyer ..... E03B 3/14 166/254.2
2013/0146281 A1 * 6/2013 Noui-Mehidi ..... E21B 43/26 166/249
2014/0305877 A1 * 10/2014 Cioanta ..... E21B 28/00 210/739
2015/0247381 A1 * 9/2015 Pursley ..... E21B 37/06 166/304
2016/0053571 A1 * 2/2016 Ludewigt ..... E21B 7/20 166/285

FOREIGN PATENT DOCUMENTS

RU 2359114 C2 6/2009
RU 2540767 C1 10/2015
SU 1657631 A1 6/1991
WO 2011145979 A1 11/2011

OTHER PUBLICATIONS

International Search Report and Written Opinion dated May 10, 2016.
2nd Written Opinion dated Oct. 13, 2017.
International Preliminary Report on Patentability dated Dec. 5, 2017.

* cited by examiner

METHOD AND DEVICE FOR SONOCHEMICAL TREATMENT OF WELL AND RESERVOIR

CROSS-REFERENCE TO RELATED APPLICATION

This application is a national filing of PCT International Application No. PCT/RU2015/000493, filed on Aug. 6, 2015, entitled "METHOD AND DEVICE FOR SONOCHEMICAL TREATMENT OF WELL AND RESERVOIR". The disclosure of International PCT Application No. PCT/RU2015/000493 is incorporated herein by reference.

FIELD

The present invention relates generally to enhanced oil recovery from subterranean reservoirs, and particularly to methods and devices for sonochemical treatment of wells and hydrocarbon reservoirs.

BACKGROUND

Oil recovery efficiency from subterranean reservoirs containing viscous hydrocarbons may be improved or enhanced with the injection of a chemical agent, such as solvent, surfactant, diluting liquid, detergent, wetting agent, emulsifier, foaming agent, or dispersant, into the reservoir. Enhanced oil recovery (EOR) techniques also include injection of heat energy, such as using steam or heated fluid, or injection of sound energy, such as using ultrasonic or supersonic waves. It has been recognized that sound waves or acoustic energy can be used to heat and reduce the viscosity of oil, increase the permeability of the reservoir formation, and generally induce migration of oil in the formation into the well bore.

For example, U.S. Pat. No. 6,279,653 to Wegener et al., dated Aug. 28, 2001, discloses an apparatus and process for producing heavy crude oil from a subterranean formation penetrated by a vertical well. In this process, an aqueous alkaline chemical solution is introduced into or formed in the well bore. The aqueous alkaline chemical solution mixes and reacts with produced heavy crude oil in the vertical well bore and ultrasonic waves are emitted into the mixture to form an emulsion.

EOR through horizontal wells presents unique challenges, as compared to recovery through vertical wells, but also presents opportunities for innovative techniques to achieve improved results or efficiency.

SUMMARY

It has been surprisingly discovered that synchronized injection of a chemical agent and sound energy into a well penetrating a hydrocarbon reservoir can provide a synergistic effect on production performance.

Thus, in one aspect, the present disclosure relates to a method and a downhole tool assembly for sonochemical treatment of a well in a reservoir.

In an embodiment of a method disclosed herein, the method comprises simultaneously injecting a chemical agent, through an injector, into a perforated wellbore section of a well in a hydrocarbon reservoir, and generating an acoustic wave with an acoustic tool positioned in the perforated wellbore section, while the injector and acoustic tool are moved to and fro in synchronization, wherein the acoustic tool comprises at least one of a sonotrode for generating an ultrasonic wave and a shock wave tool for generating a hydraulic shock wave.

In this method, the acoustic tool may comprise one or more sonotrodes. The acoustic tool may comprise one or more shock wave tools. A cyclic fluid pressure may be applied in the perforated wellbore section of the well. The injector and the acoustic tool may be connected to a cable hose for moving the injector and acoustic tool to and fro in synchronization. The cable hose may comprise a wire for supplying power to the acoustic tool and having a conduit for supplying the chemical agent to the injector. The cable hose may comprise an armored cable body defining the conduit. The cable hose may further comprise a signal wire for transmitting a signal therethrough. The well may be a horizontal well. The acoustic tool may generate a radially propagating acoustic wave.

In an embodiment of a downhole tool assembly disclosed herein, the tool assembly comprises an injector positioned in a well penetrating a hydrocarbon reservoir, for injecting a chemical agent into a perforated wellbore portion of the well; an acoustic tool positioned in the perforated wellbore portion of the well for generating an acoustic wave, the acoustic tool comprising at least one of a sonotrode for generating an ultrasonic wave and a shock wave tool for generating a hydraulic shock wave; and a movable cable hose connected to the injector and the acoustic tool for moving the injector and acoustic tool to and fro in synchronization, the cable hose comprising a wire for supplying power to the acoustic tool and having a conduit for supplying the chemical agent to the injector.

In this tool assembly, the acoustic tool may comprise one or more sonotrodes. The acoustic tool may comprise one or more shock wave tools. The cable hose may comprise an armored cable body defining the conduit. The cable hose may further comprise a signal wire for transmitting a signal therethrough. The sonotrode has an oscillation frequency from 10 to 50 kHz. The sonotrode may comprise a tubular housing defining a cavity, an electroacoustic transducer and cooling oil disposed in the cavity, and a pressure compensator. The tool assembly may comprise a plurality of sonotrodes each having a distinct resonance frequency, wherein the resonance frequencies of the sonotrodes differ from one another by at least 1 kHz. The tool assembly may further comprise a jet pump disposed in the well for reducing a fluid pressure in the perforated wellbore section of the well, the jet pump having a channel for receiving the cable hose to allow the cable hose to pass through the jet pump, the jet pump comprising a pressure-actuated sealing device mounted in the channel for sealing around the cable hose. The sealing device may comprise two ring members connected by a plurality of resilient panels, the panels normally circumferentially separated by a gap, wherein under pressure the panels are bendable inwardly to abut one another so as to form a seal. The tool assembly may comprise a flexible connector connecting the acoustic tool to the injector.

Other aspects, features, and embodiments of the present disclosure will become apparent to those of ordinary skill in the art upon review of the following description of specific embodiments in conjunction with the accompanying figures.

BRIEF DESCRIPTION OF THE DRAWINGS

In the figures, which illustrate, by way of example only, embodiments of the present disclosure.

DETAILED DESCRIPTION

Figure 1:
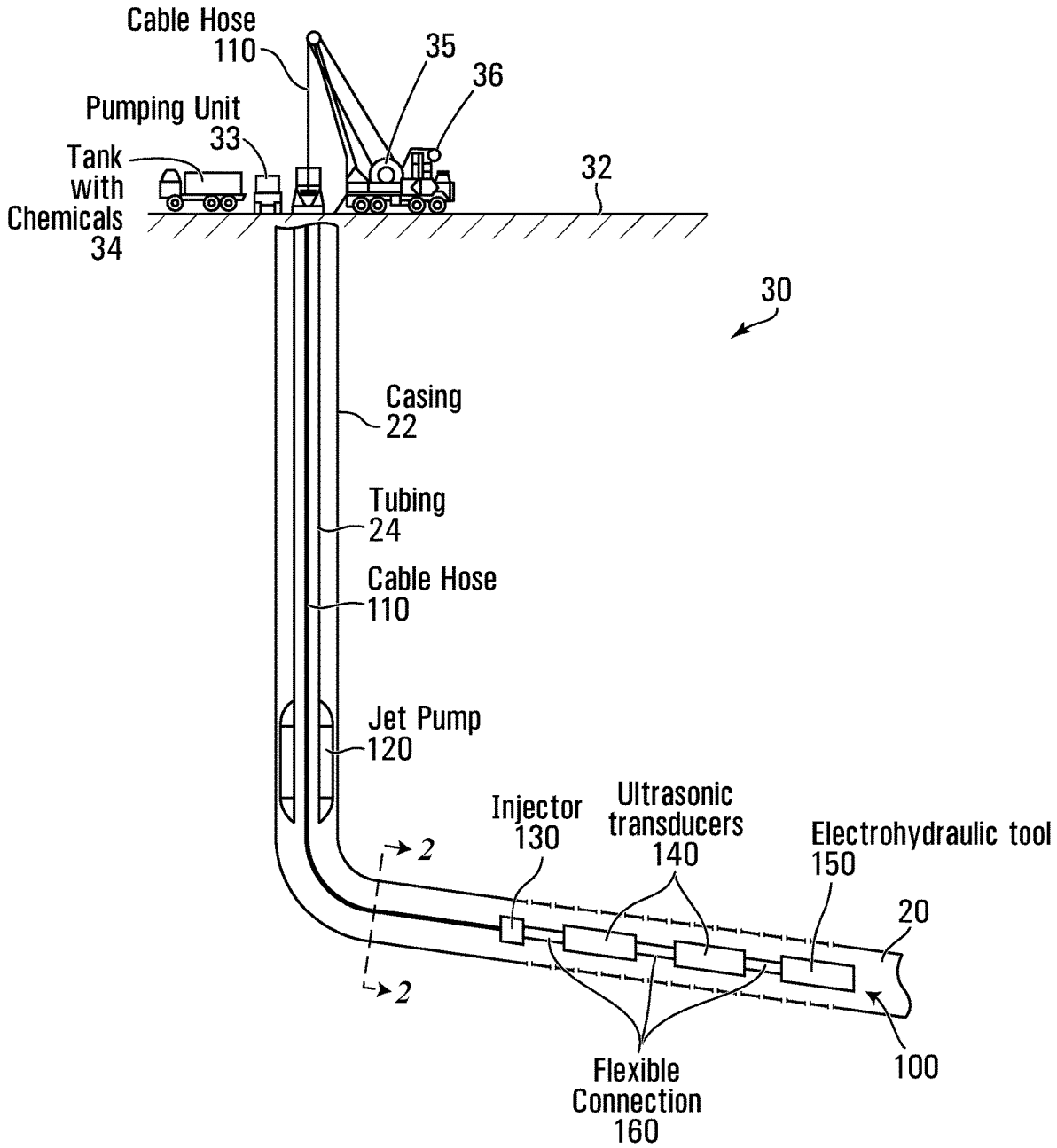
FIG. 1 is a schematic diagram of a tool assembly deployed in a horizontal well in a reservoir of viscous hydrocarbons, according to a selected embodiment of the present disclosure.

In an embodiment, a tool assembly is provided for treating a perforated wellbore portion of a horizontal well in a reservoir of hydrocarbons and a volume of the reservoir proximate the perforated wellbore portion of the horizontal well, as depicted in FIG. 1.

As depicted in FIG. 1, a horizontal well 20 penetrates a reservoir 30 containing hydrocarbons. Horizontal well 20 is completed with a cement casing 22 around the perimeter of the wellbore, as can be understood by those skilled in the art. Casing 22 at a horizontal section of well 20 is perforated and has perforations extending through cement casing 22 to provide fluid pathways and fluid communication between well 20 and reservoir 30. As is typical, a string of tubing 24 extends into well 20 from surface 32. Tubing 24 may be used to transport or lift fluids produced from reservoir 30 to surface 32, and may be connected to a pumping unit, such as pumping unit 33 at surface 32, or another pump disposed downhole (not shown). For example, a submersible electric pump (SEP) may be used downhole to drive fluid flow in tubing 24.

It is noted that other necessary or optional components or well completion parts or tools, such as liners, packers, hangers, working strings, tubing, sensors, cables, joints, pumps, wire or cable racks, or the like, may also be provided, and installed, as are known to those skilled in the art. The sensors may include, for example, manometers, and thermometers or thermocouples, or the like. However, the exact structures and details of well 20, casing 22 including its perforations, tubing 24, any pumping unit including pumping unit 33, the other necessary and optional components, parts, or tools, and the associated equipment, are not critical to the present disclosure and have been generally described only to the extent necessary to illustrate this embodiment of the present disclosure. The nature and operation of such components, parts, tools, and equipment are known to those skilled in the art, and can be selected and implemented by those skilled in the art as suitable in a given application, in combination with the components and downhole tools expressly described in this disclosure.

As used herein, a horizontal well refers to any well that has an extended lateral wellbore section that extends generally substantially in the horizontal direction. A section of a horizontal well may extend from the surface 32 generally vertically (as illustrated in FIG. 1), or at an inclined angle (not shown), down to a selected level into the reservoir formation. It is not necessary that the entire wellbore of a horizontal well is leveled in the horizontal direction.

As used herein, the term "surface", in expressions such as "the surface", "at surface", "from surface", or the like, should be understood to refer to the earth surface, or generally any facilities or equipment located above or on the ground near the top end of horizontal well, unless the term is otherwise qualified or the context makes it clear that the term refers to a particular surface other than the earth surface.

FIG. 1 also depicts a tool assembly 100, which includes a cable hose 110, a jet pump 120, a hydraulic giant 130, an acoustic tool unit which includes one or more of sonotrodes 140 and an electrohydraulic shock wave tool 150, and flexible connectors 160 for connecting various components or units in the tool assembly. The combination of hydraulic giant 130, sonotrodes 140, shock wave tool 150, and flexible connectors 160 may be considered as a unit collectively referred to as a downhole tool or a downhole tool unit.

Cable hose 110 is used primarily to transport a chemical agent into the perforated wellbore section of well 20. However, as will be further described and will become apparent below, cable hose 110 is also configured and adapted to provide additional functionalities, including transmission of electrical power to other downhole tools such as sonotrodes 140 and shock wave tool 150, and for running other downhole tools in the assembly and actuating continuous movement of such tools, so that synchronized movement of such tools with the injector of the chemical agent can be conveniently effected and controlled. Cable hose 110 may also be used to flow other fluids downhole. For example, cable hose 110 may be used to transport a cleaning fluid downhole to wash and clean a perforated portion of well 20, either before or after chemical treatment, as will be further described below.

Figure 2:
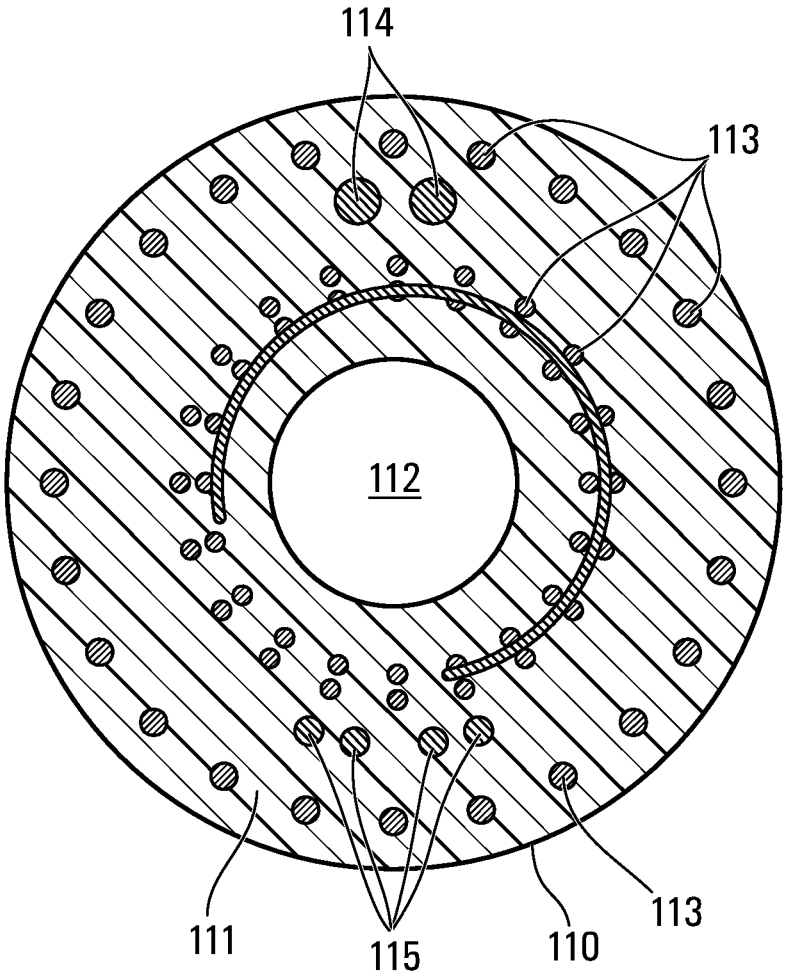
FIG. 2 is a cross-sectional view of the cable hose shown in FIG. 1, taken along line 2-2.

Cable hose 110 is flexible and may be formed with an armored plastic cable body. FIG. 2 depicts a transverse cross-sectional view of cable hose 110. As illustrated in FIG. 2, cable hose 110 includes a plastic core 111 defining a fluid conduit 112. A plurality of wires, including armor wires 113, power wires 114, and signal wires 115, are embedded and extend in plastic core 111. Armor wires 113 are used to provide mechanical strength and may be made of steel such as a suitable stainless steel.

Armor wires 113 may also be made of another material with suitable mechanical properties, and do not need to be electrically conductive.

Power wires 114 are used to transmit electrical power. Signal wires 115 are used to transmit electric or electronic signal. Both power wires 114 and signal wires 115 are made of a suitable electrically conductive material, such as copper or the like. Power wires 114 and signal wires 115 may be made of the same material but their gauge size may be different, as a power wire may have a larger gauge size than a signal wire. The gauge size of a power wire may also vary depending on the power required to power a particular downhole tool or equipment. For example, in a particular embodiment, a suitable copper power wire may have a diameter of about 1.5 mm, and a copper signal wire may have a diameter of 0.5 mm or less. The power rating for power wires 114 may be up to 5 kW. While two power wires and four signal wires are shown in FIG. 2, it should be understood that the numbers of power wires 114 and signal wires 115 may vary in different applications, and may be selected depending on the number downhole tool units to be powered and the number of signals to be transmitted from downhole to surface. Signal wires 115 may be used to transmit data signal from a downhole tool or equipment such as a sensor to a surface apparatus or unit, and transmit control signal from a surface apparatus or unit to a downhole tool or equipment, as needed.

The diameter of cable hose 110 may be selected such that the diameter of fluid conduit 112 is optimized for a given wellbore size and the downhole room available for cable hose 110. Generally, a larger diameter for fluid conduit 112 may be desirable to achieve a higher flow rate under the same fluid pressure. However, the size of cable hose 110 and hence the size of fluid conduit 112 may be limited by available space within the wellbore. In a particular embodiment, the diameter of fluid conduit 112 may be about 15 mm. The diameter of cable hose 110 may be selected to ensure that cable hose 110 is of sufficient mechanical strength for performing the desired functions and have sufficient durability. In an embodiment, the outer diameter of cable hose 110 may be 44 mm. The inner surface fluid conduit 112 may be formed of a material chemically resistant to any chemical agent to be transported through conduit 112. For example, if an acidic fluid is to be transported through conduit 112, the inner surface of conduit 112 may need to be acid-resistant. This may be achieved by selecting a suitable acid-resistant core material, or by coating an acid-resistant material on the inner wall of conduit 112. A suitable material for the core of cable hose may be a polymer.

As can be seen in FIG. 1, cable hose 110 extends from surface 32, and the surface end of cable hose 110 is connected to a source 34 of a chemical agent for supplying the chemical agent into conduit 112 of cable hose 110. Cable hose 110 is also wound onto a cable drum 35 on a cable truck 36. Source 34 may be provided in any suitable manner or form, such as by way of a stationary or movable tank, or a truck carrying a fluid container. Cable hose 110 is deployed and actuated during operation by turning cable drum 35 on truck 36. Conveniently, a geophysical truck may be adapted to carry and operate cable hose 110. A specially designed and configured truck may also be used.

Cable hose 110 may be otherwise deployed and actuated without truck 36, such as by using a suitable cable winding device with a motorized spindle or winding wheel (not shown). However, as can be appreciated by persons skilled in the art, using a truck carrying a cable drum can provide certain benefits and advantages. For example, the cable truck can be easily moved about either on site, or from site to site, without having to load and unload cable hose 110 for relocation. The length of cable hose 110 may be quite long, such as up to hundreds meters, or more than one kilometer, depending on the lengths of the wells in which cable hose 110 is to be used. For this purpose, armored cable hose 110 is beneficial as armor wires 113 can provide additional stretching, bending (breaking) and torsional strength and stiffness.

Conveniently, geophysical signals from geophysical sensors (not shown) deployed downhole in well 20 may be transmitted to data analysis units (not shown) on geophysical truck 36 through one or more signal wires 115.

While specific embodiments of cable hose 110 are described above, it should be noted that cable hose 110 may be modified, such as by using different materials and constructions, but still provides the same or similar functionalities as described above. For example, the cable body may be formed of a material other than a polymer plastic, as long as the material can provide sufficient physical strength and flexibility and chemical stability for the intended use. The wires may also be formed of different materials for conducting electricity.

The downhole end of cable hose 110 extends to a downhole location near the perforated section of well 20, and passes through a junction at which a jet pump 120 is located.

Jet pump 120 may be any suitable conventional jet pump that has been modified as described below to allow cable hose 110 to pass through jet pump 120 and form a pressure seal around cable hose 110 in jet pump 120. The purpose and operation of jet pump 120 will be described below.

Below the junction where jet pump 120 is located, a packer (not shown) is set to isolate the sections of well 20 above and below the packer and jet pump 120, or in other words, to isolate tubing 24 from the section of well 20 above the packer.

Figure 3:
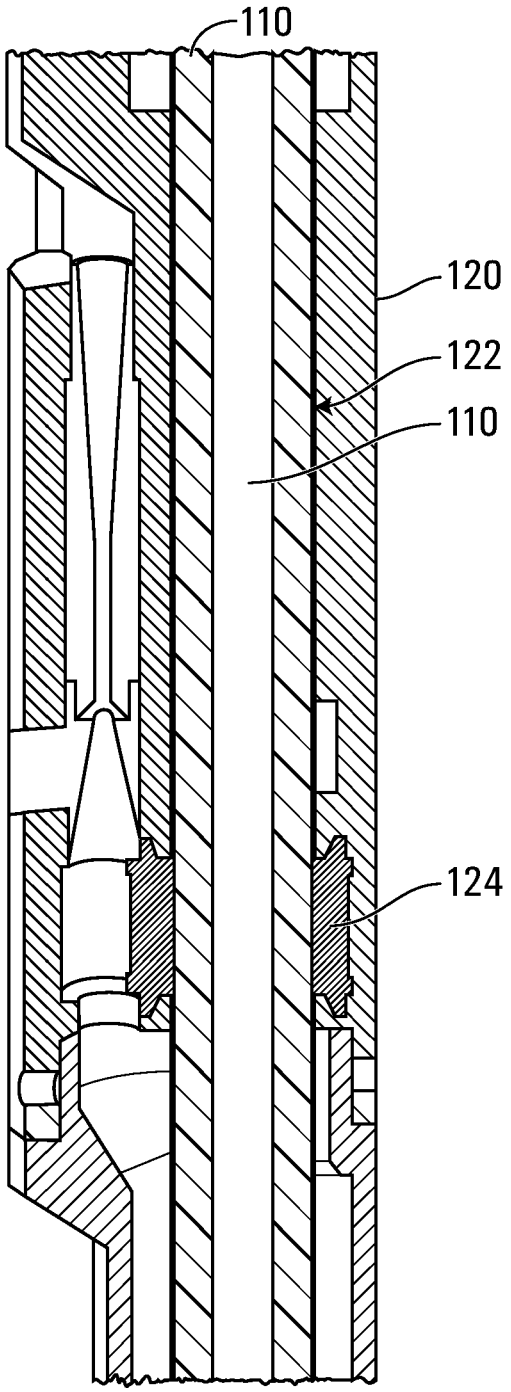
FIG. 3 is a schematic section elevation view of a section of the jet pump and cable hose shown in FIG. 1.
Figure 3A:
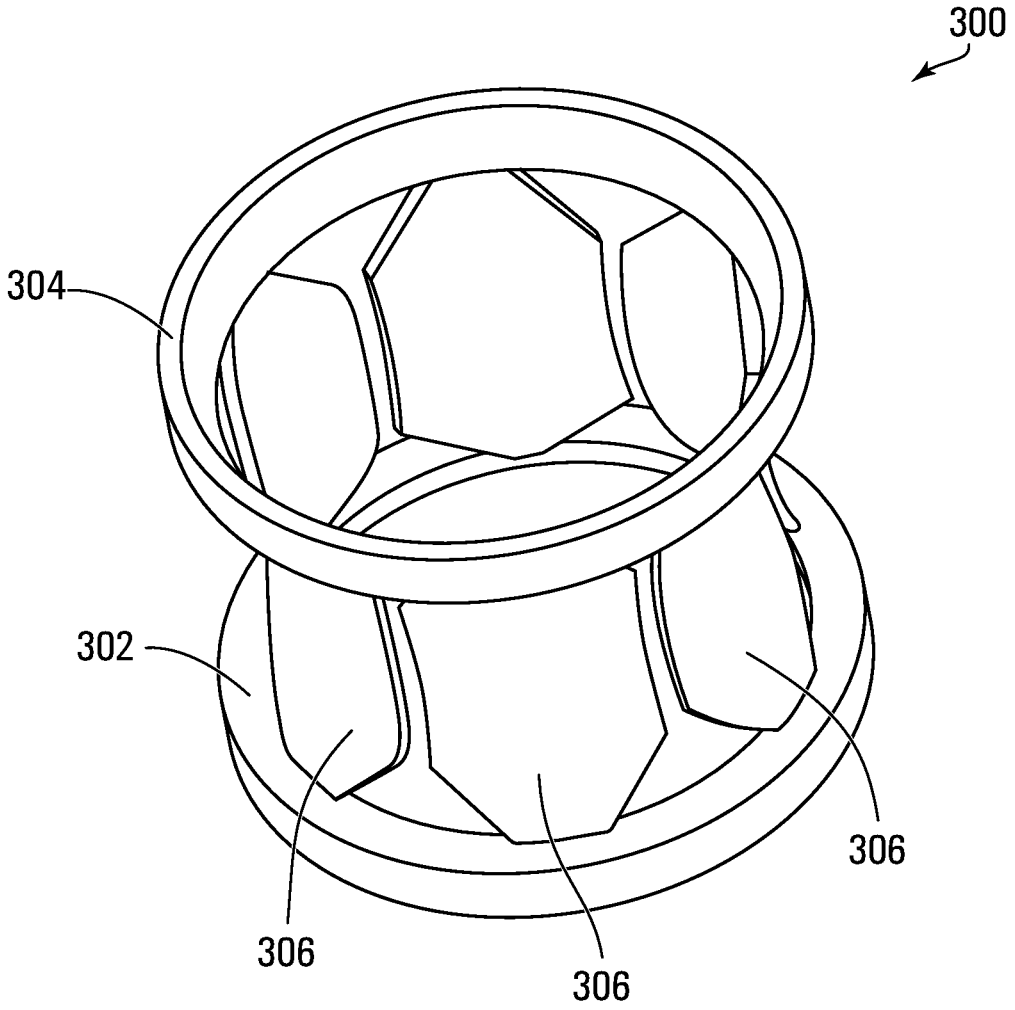
FIG. 3A is a perspective view of a sealing member for use in the jet pump of FIG. 1.

Jet pump 120 is configured to allow cable hose 110 to pass therethrough and provide a pressure seal around cable hose 110 in jet pump 120. A specific possible configuration for this purpose is schematically illustrated in FIG. 3, which shows only relevant parts of cable hose 110 and jet pump 120. As depicted, jet pump 120 may have a through channel 122 sized to allow cable hose 110, and any downhole tool connected to cable hose 110, to pass through. A pressure-actuated sealing member 124, which may be a sealing device 300 as separately illustrated in FIG. 3A and further described below, is mounted in channel 122.

Sealing device 300 has two O-ring shaped ends 302, 304, connected by a number of evenly spaced, octagon-shaped flexible fitting panels 306. In a selected embodiment, 6 panels 306 may be provided. Panels 306 are slightly bent inwardly and are made of a resilient material, such as a polytetrafluoroethylene (PTFE). The inner diameter of sealing device 300 is sized to fit over cable hose 110. Cable hose 110 can pass through the space between ends 302, 304 and fitting panels 306, when panels 306 are not compressed inwardly by a fluid pressure. The initial gaps between fitting panels 306 in the normal (un-pressed) condition are precisely selected such that when fitting panels 306 are pressed tightly against cable hose 110, they also tightly abut and engage one another to form a seal around cable hose 110. Ends 302, 304 of sealing device 300 are affixed to the inner wall of channel 122 in jet pump 120. In use, after insertion of cable hose 110 through channel 122 and sealing device 300, when a fluid pressure is applied through tubing 24 into jet pump 120 (such as by a pumping unit at surface), fitting panels 306 bend further inwardly and closely and tightly engages the outside perimeter of cable hose 110 and with each other to form a tight fluid seal, yet still allowing cable hose 110 to slidably move back and forth during operation. The seal prevents fluid communication between tubing 24 above jet pump 120 and the perforated wellbore section of well 20, so that a pressure differential can be established therebetween. In an embodiment, a pressure differential up to 400 atm may be created by jet pump 120.

The downhole end of cable hose 110 is connected and coupled to hydraulic giant 130, which has a nozzle head (not separately shown) in fluid communication with conduit 112 for injecting the chemical agent, or any other fluid flowing in conduit 112, into reservoir 30 through the perforated section of well 20. In different embodiments, hydraulic giant 130 may be replaced with another type of nozzle device for injecting fluid into the wellbore of well 20. In some embodiments, the nozzle of hydraulic giant 130 may be oriented to inject the fluid at an about 45 degree angle to the axial direction of well 20.

In different embodiments, hydraulic giant 130 may be modified or replaced with any suitable device for injecting the chemical agent into the wellbore. Such a device may be broadly referred to as an injector (not an injection well) for injecting the chemical agent. The injector may include a nozzle, a tubing, or another fluid device that can be conveniently coupled to the downhole end of cable hose 110 for dispersing the chemical agent in a desired manner.

One or more sonotrodes 140 may be connected by flexible connectors 160 to the downhole end of cable hose 110, in series. The power input of each sonotrode 140 is connected directly or indirectly to a power wire 114 of cable hose 110. To this end, a wire rack (not shown) may be provided near hydraulic giant 130, for connecting with power wires 114 and signal wires 115. Lead wires (not shown) may be provided to connect input or output terminals in different downhole tools or equipment to the wire rack for respective electrical connection with power wires 114 and signal wires 115.

Figure 4:
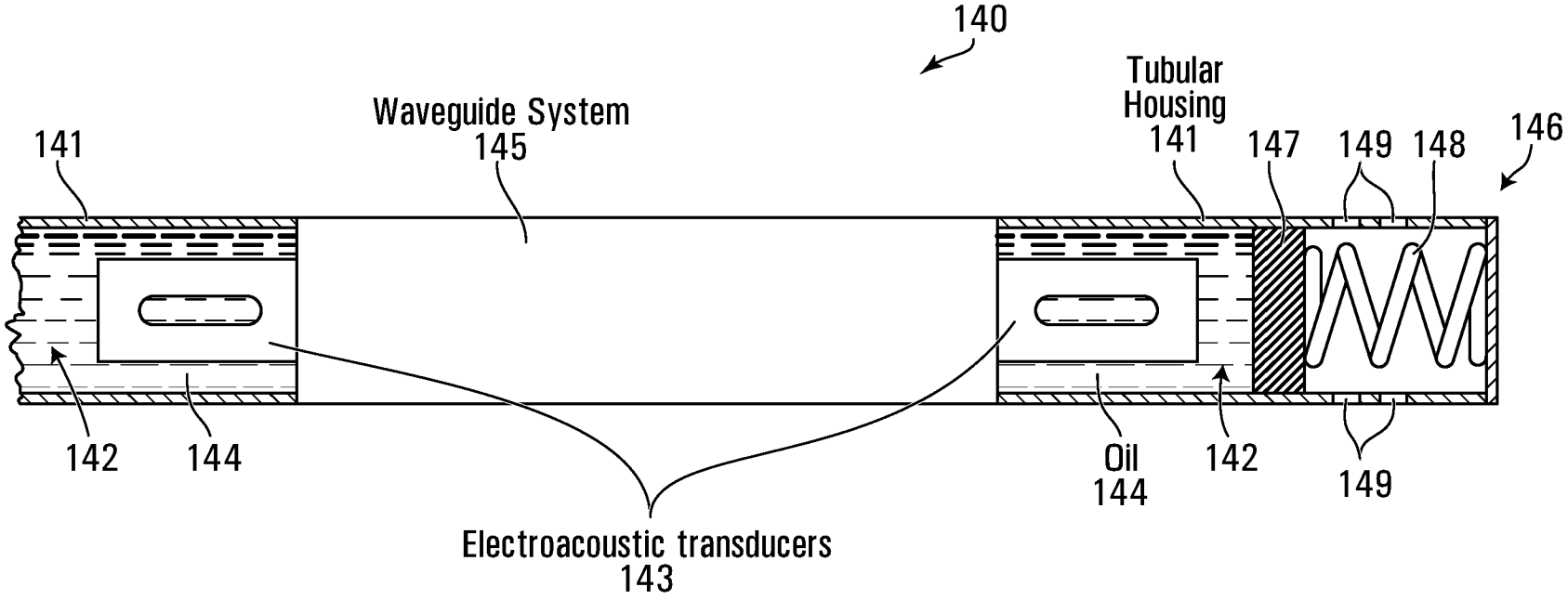
FIG. 4 is a schematic section view of a sonotrode for use in the tool assembly of FIG. 1.

A selected embodiment of a suitable sonotrode 140 is schematically illustrated in FIG. 4. As depicted, sonotrode 140 may include a tubular housing 141, which defines a cavity 142, which may have a cylindrical shape. One or more electroacoustic transducers 143 (two transducers 143 are depicted in FIG. 4) and a cooling liquid 144, such as oil, may be disposed in cavity 142. As can be understood by those skilled in the art, sonotrode 140 may also include a waveguide 145. An electrical conducting wire (not shown for simplicity) is wound about each transducer 143 and connected to a power source for generating varying magnetic field in the transducer 143.

A pressure compensator 146 may also be provided in housing 141, which includes a wall plate 147 that is slidably and sealingly movable in cavity 142. Wall plate 147 is biased against a spring 148 mounted on an end wall of housing 141. Housing 141 also have openings 149 in the section between wall plate 147 and the housing end wall on which spring 148 is mounted, to provide fluid communication with the surrounding area in well 20. The strength of spring 148 is selected to provide pressure balance between the pressure in cavity 142 and the fluid pressure in the surrounding area in well 20. When the surrounding pressure is reduced, such as due to operation of jet pump 120, spring 148 may be compressed by wall plate 147 due to a higher pressure in cooling liquid 144. When the surrounding pressure is increased, such as due to the fluid injection through cable hose 110, the combined force by the surrounding pressure and spring 148 pushes wall plate 147 to compress cooling liquid 144 thus increasing its pressure. Therefore, the pressures inside and outside cavity 142 are balanced and compensated. The pressure load on spring 148 may be up to about 2 to about 3 atm. A minimum pressure of 2 to 3 atm may be maintained in cavity 142 at all times in order to avoid cavitation inside cavity 142 and prevent damage to wires or other components inside cavity 142.

In some embodiments, transducers 143 may include an electric powered magnetostrictive transducer, and may be made of permendur. In some embodiments, other suitable materials with magnetostrictive properties may be used. As is known to those skilled in the art, an electrical coil may be wound around a transducer 143 to induce an alternating magnetic field in the transducer body when an alternating electrical current is applied through the coil. The varying magnetic field causes the transducer body to expand or contract, resulting in a corresponding oscillating displacement of an adjacent object abutting the actuator, such as waveguide 145 shown in FIG. 4. When the oscillation frequency is suitably selected, ultrasonic waves are generated and transmitted outward into the surroundings. Sonotrodes 140 may be configured to maximize radial dispersion of ultrasonic waves.

As used herein, unless otherwise specified, a radial direction refers to a direction that is perpendicular to the axial direction of the tool in question, or to the axial direction of the wellbore in which the tool is located. Typically, the axial direction of an elongated tool is aligned generally with the axial direction of the wellbore.

The operation of each sonotrode 140 may be controlled from surface by adjusting the power applied to the sonotrode and by actuating cable hose 110 to move sonotrodes 140 back and forth in the axial direction. Each sonotrode is constructed and configured to generate and direct ultrasonic waves into a volume of the reservoir near well 20 through the perforated wellbore portion of well 20. To this end, sonotrodes 140 are constructed and configured to produce sufficient radial oscillation.

Various conventional sonotrodes are known to persons skilled in the art and the persons skilled in the art will be able to design and construct sonotrodes having the above discussed features and properties. For example, transducers suitable for use in vertical wells have been described in U.S. Pat. No. 7,063,144 to Abramov et al., issued Jun. 20, 2006, and U.S. Pat. No. 7,059,403 to Barrientos et al., issued Jun. 13, 2006, the entire contents of each of which are incorporated herein by reference. The devices described in U.S. Pat. Nos. 7,063,144 and 7,059,403 may be modified and adapted for use in an embodiment of the present disclosure. Other example sonotrodes and operations thereof are described in U.S. Pat. No. 7,059,413 to Abramov et al., issued Jun. 13, 2006, the entire contents of which are incorporated herein by reference. Example sonotrodes and associated surface equipment are also described in Abramova, A. et al., "Ultrasonic Technology for Enhanced Oil Recovery", *Engineering*, (2014), 6, pp. 177-184, the entire contents of which are incorporated herein by reference.

Test results have shown that a push-pull type sonotrode may be beneficial in some embodiments, where longitudinal oscillation in such a sonotrode is converted to radial oscillation, and sonic waves are emitted mainly radially, when the radial and longitudinal frequencies are matched with the specified margin. Radially emitting sonic waves can increase the efficiency of the sonotrodes.

In different embodiments, the operating frequency of the sonotrodes may vary. In a selected embodiment, the operating or resonance frequency may be about 20 kHz. In some embodiments, the resonance frequency may be from about 10 to about 50 kHz, or from about 15 to about 30 kHz. The input power for each sonotrode may be in the range of about 2 to about 3 kW, up to 10 kW, or higher. A sonotrode may have an output power of about 1.5 to about 5 kW.

When selecting the sonotrodes to be used and powering the sonotrodes, it may be born in mind that in some embodiments, the threshold energy intensity for achieving acoustic effects in subterranean oil and rocks (or oil sands) may be 0.8 to 1 $W/cm^2$. Thus, the sonotrodes should be configured and arranged to achieve at least such acoustic energy intensity in a volume of the reservoir formation near the wellbore such as within a meter from the wellbore casing.

When multiple acoustic tools such as sonotrodes 140 or shock wave tool 150 are used in the same downhole tool unit, the acoustic tools may be connected in series with flexible connectors 160, and by conductive wires or cables. Each sonotrode 140 in the same assembly or unit may have a distinct resonant frequency, and the resonant frequencies of different sonotrodes 140 may differ from each other by at least about 1 kHz. As can be appreciated, ultrasonic waves with different frequencies may penetrate into a medium to different depths.

Multiple sonotrodes 140 may be evenly spaced, and may extend over substantially the entire perforated section of well 20. The number of sonotrodes 140 and how they are placed may be determined based on a number of factors including the length of the perforated wellbore section, fluid flow rate, operation efficiency, effectiveness, cost, and others.

The operation of sonotrodes 140 may be controlled at surface, such as at a control station (not shown) located at surface. The control signal and feedback may be applied through power wires 114 and signal wires 115 of cable hose 110. One or more power sources or generators (not shown) may be also be provided at surface for providing electrical power to sonotrodes 140 through power wires 114 of cable hose 110.

Shock wave tool 150 may be optionally provided as the terminal unit in the downhole tool assembly. A shock wave refers to a type of propagating disturbance that moves in a medium, where the wave of disturbance moves faster than the speed of sound in a liquid or gas. Any suitable shock wave tool known to those skilled in the art may be used. While an electrohydraulic shock wave tool may be suitable and conveniently used, other types of shock wave tools may also be used in different applications. Like sonotrodes 140, shock wave tool 150 may be controlled and powered by a surface control station or power source (not shown) by connection through cable hose 110. Shock wave tool 150 may be selected to generate low frequency, high energy (such as up to 10 Mw) elastic waves.

Figure 5:
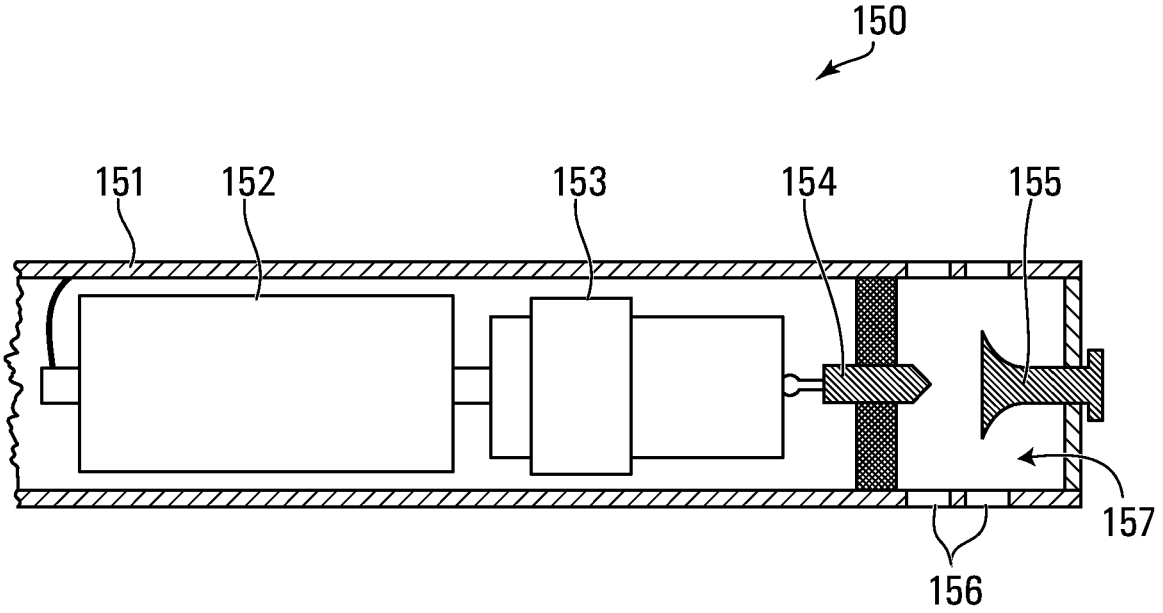
FIG. 5 is a schematic section view of a shock wave tool for use in the tool assembly of FIG. 1.

In selected embodiments, shock wave tool 150 may have a construction as illustrated in FIG. 5. As depicted, shock wave tool 150 may include a housing shell 151. A storage capacitor 152, a discharger 153 and electrodes 154 and 155 are mounted in shell 151. Capacitor 152 can be connected to a power source (not shown), such as through a power wire 114, for charging. Housing shell 151 has openings 156 that allow fluid communication between chamber 157 and the surrounding environment.

When capacitor 152 is charged up to the breakdown voltage of the discharger 153, a pulse electric discharge between first and second electrodes 154, 155 is induced, which produces a pulse of very high hydraulic pressure (shock wave). Repeated discharge produces a shock wave that propagates radially out of the shell 151, through openings 157. The hydraulic pressure or shock wave can be used to do useful work, such as stimulating the wellbore or the reservoir formation. As can be appreciated, low-frequency high-energy shock wave has been found to be effective for dislodging oil droplets and coalesce oil films.

Tool assembly 100 may be guided by, or hang on, another working string (not shown) previously disposed downhole.

As now can be appreciated, downhole tools connected to the cable hose 110, such as hydraulic giant 130, sonotrodes 140, and shock wave tool 150 should be sized so that they can be conveniently inserted through tubing 24 and jet pump 120. For this reason, each of the downhole tools may be sized to have a diameter similar to or smaller than the outer diameter of cable hose 110. Since it may be desirable to provide larger tools to the extent possible under the wellbore constraints, these downhole tools may have the same outer diameter as cable hose 110. For example, cable hose 110, sonotrodes 140, and shock wave tool 150 may each have an outer diameter of about 44 mm.

While not expressly shown, it should be understood that suitable coupling, connecting or engaging devices or components will be required to connect, couple, or engage different tools and devices to each other. For example, cable couplings and seal couplings may be provided to couple cable hose 110 to hydraulic giant 130. At hydraulic giant 130, cable hose 110 may be coupled to a lug (not shown), and may be partially terminated or cut off, but power and signal wires 114 and 115 may extend further downhole, to provide lead lines for connecting with other downhole tools.

In some embodiments, and depending on the application, the acoustic tool unit connected to cable hose 110 may include only one sonotrode, or only one shock wave tool. In other embodiments, the acoustic tool unit may include multiple sonotrodes only. In some embodiments, the acoustic tool unit may include multiple shock wave tools only. In some embodiments, the acoustic tool unit may include multiple sonotrodes and multiple shock wave tools.

During use, at a selected time during well completion, and prior to normal production, various necessary and optional equipment, devices and downhole tools may be lowered into the wellbore of wells 20. Fixtures such as packers, a working string (not shown), a housing component or platform (not shown) for housing jet pump 120, and tubing 24 may be installed or put in place in casing 22. Jet pump 120 is installed into place on tubing 24.

The downhole tool unit including shock wave tool 150, sonotrodes 140, hydraulic giant 130, and flexible connectors 160, which are connected in series as shown in FIG. 1, is connected to the downhole end of cable hose 110, and run downhole using cable hose 110 through tubing 24 in casing 22, and then through jet pump 120. Cable hose 110 may be lowered into well 20 by un-winding the drum 35 on cable truck 36.

The wellbore of well 20 is separated into two portions, an upper portion above the packer at/near jet pump 120, and a lower portion below the packer. Due to the sealing provided at packer and at jet pump 120, including sealing provided by sealing device 300, fluid communication between the two portions is provided only through cable hose 110 or jet pump 120.

A selected chemical agent is injected into the lower portion, particularly the perforated section, of well 120 through the fluid conduit 112 of cable hose 110 and the nozzle of hydraulic giant 130. The fluid flow in conduit 112 may be driven by applying fluid pressure at the source 34 or using a pump in a suitable manner. The chemical agent may be selected based on the desired chemical treatment to be applied to the volume of reservoir formation near the perforated wellbore section of well 20. Thus, various chemical agents may be selected as understood by those skilled in the art, including those discussed above and elsewhere herein. In some embodiments, the chemical agent may be an acid, oxidant, enzyme, chelate, solvent, surfactant, diluting liquid, detergent, wetting agent, emulsifier, foaming agent, or dispersant, or any combination thereof. The chemical agent may be selected so that when it is dispersed into the reservoir formation, it tends provide the effect of increased mobility of a fluid in the formation or otherwise improving production rate.

Simultaneously, electrical power is applied to the acoustic tools such as sonotrodes 140 and shock wave tool 150 through power wires 114 of cable hose 110 to generate radially propagating acoustic waves to stimulate the perforated wellbore section of well 20 and the volume of reservoir formation near the perforated wellbore section. The point of chemical injection into well 20 and the points of sound energy injection are spatially close and kept at a given distance.

While chemical injection and acoustic stimulation are taking place, the hydraulic giant 130 and the acoustic tool unit (including sonotrodes 140 and shock wave tool 150) are kept in motion and are moved to and fro by actuation of cable hose 110. The movement of hydraulic giant 130 and the acoustic tool unit, i.e., the movement of the point of chemical injection into well 20 and the points of acoustic energy injection, is therefore synchronized in time.

During injection of chemicals, a fluid pressure may build-up in the lower section of well 20. Thus, after a period of sonochemical treatment, or during an interval between two sonochemical treatment periods, jet pump 120 may be operated to reduce the downhole pressure in the lower section of well 20. The downhole pressure is thus alternately increased and reduced (referred to as pressure cycling or cyclic pressure), which can induce back and forth fluid movement in the lower section of well 20 and in adjacent regions in reservoir 30. Such fluid movement can conveniently promote penetration of the chemical agent into pores in the adjacent regions of reservoir 30, and can produce a "washing" effect in the fluid path.

Conveniently, the simultaneous injection of chemical agent and ultrasonic energy into the perforated wellbore section and the volume of reservoir formation nearby, and the synchronized movement of the injection points, can provide synergistic effects, and improve the efficiency and effectiveness of the sonochemical treatment of the volume of reservoir formation near the perforated wellbore section and the perforated wellbore section itself.

For example, and without being limited to any particularly theory, it may be expected that certain beneficial effects, such as fluid viscosity reduction and mobility increase, induced by ultrasonic stimulation, can assist fluid movement and dispersion of the chemical agent into the volume reservoir formation near the perforated wellbore section. However, such beneficial effects may quickly disappear or be reduced after ultrasonic stimulation is terminated. For example, some effects may be reduced within tens of seconds or a few minutes after termination of ultrasonic stimulation. While the volume of reservoir formation is still stimulated by sufficient ultrasonic energy, the chemical agent may disperse deeper and faster into the reservoir. In addition, some chemical or physical bonds between various molecular species or materials in the reservoir formation may be temporarily broken due to the ultrasonic stimulation, which may allow the chemical agent to react with such molecular species or materials. Further, the amplitude of ultrasonic waves propagating in the reservoir formation may decay quickly and the effective region of ultrasonic stimulation tends to be limited to within a short radial distance from the perforated section of well 20. With the injection of the chemical agent, which may result in increased porosity in the volume and may soften the formation, thus allowing the ultrasonic waves to propagate deeper or with a higher energy intensity into the reservoir formation. Consequently, the effectiveness and treatment efficiency may be improved. The synchronized movement of the chemical and ultrasonic injection points may allow the wellbore and the reservoir formation to be more evenly and uniformly treated, and the above effects to be achieved. Tests have shown that continuous movement of the chemical and ultrasonic injection points may be required to avoid clogging or blockage of the perforations in the perforated wellbore section, or may be required to achieve the above discussed beneficial effects. If the downhole tool unit were kept stationary during sonochemical treatment, it might be stuck in place after a period of operation, and it would be difficult to move it again.

During the sonochemical treatment, hydraulic (fluid) shock waves may be generated using shock wave tool 150, either in addition to ultrasonic waves or as an alternative to ultrasonic waves, to improve the treatment performance. Hydraulic shock waves generated downhole typically can penetrate further into reservoir 30, and may have a higher energy transfer efficiency. Its application may be beneficial in some cases, but may also have negative effects in other cases as are known to those skilled in the art.

The skilled person will be able to determine in a particular case whether it is desirable to apply shock waves. For example, it may be more difficult to limit the effect of shock waves to within a confined zone. If there is a nearby formation structure that should not be subjected to shock wave stimulation, it may not be suitable to apply shock waves during the treatment.

The sonochemical treatment of well 20 and reservoir 30 may last any suitable period of time depending on the conditions of the particular formation, the nature of the treatment selected, and the chemical materials and sonic energy used. Depending on various factors, a sonochemical treatment may last about 30 to about 60 min per meter for a vertical well, or about 2 to 15 min per meter for a horizontal well.

The sonochemical treatment of well 20 and reservoir 30 may be repeated over time when necessary or desired. For example, during normal production of oil from well 20, production may be temporarily suspected, to allow well 20 and reservoir 30 to be subjected to a further period of sonochemical treatment to improve fluid flow into well 20.

Conveniently, cable hose 110 can be used to inject other fluid materials such cleaning fluids into well 20 for other purposes such as cleaning of the wellbore, when cable hose 110 is not used to perform sonochemical treatment. Alternatively, and optionally, an additional fluid conduit (not shown) may be provided in cable hose 110 so that an additional fluid can be supplied through cable hose 110 during sonochemical treatment.

The frequency, power and duration of ultrasonic waves to be generated may be selected based on a number of factors known to those skilled in the art and will not be detailed herein. It should be noted that continuous ultrasonic stimulation does not require constant generation of ultrasonic energy. Rather, the ultrasonic waves or stimulation may be generated continuously or pulsed at acceptable frequencies. As long as the effects of the ultrasonic stimulation in the reservoir formation are continuous and are substantially reduced, the ultrasonic stimulation may be considered continuous stimulation. For example, it may be expected certain effects of ultrasonic stimulation may decay quickly within tens of seconds or minutes. The ultrasonic stimulation may be considered to be continuous, as long as such decay is not observed or has no material or observable effect on the treatment performance.

The frequency and energy intensity of the emitted ultrasonic waves may be selected dependent on various characteristics of the materials present in the reservoir and the fluids to be produced from the reservoir, such as initial viscosity, porosity, permeability, chemical or physical composition and structure, and the like. Generally, the ultrasonic waves may be emitted at a frequency of 10 to 50 kHz, such as from about 13 kHz to about 30 kHz, from about 15 kHz to about 30 kHz, or about 20 kHz. The power of the ultrasonic waves may be from 1 to about 10 kW.

Other acoustic waves generated downhole may have a frequency from about 20 Hz to about 10 kHz.

Sonochemical treatment of a wellbore and its proximate regions in the reservoir may last minutes, hours or days.

Depending on the length of the perforated section of well 20, or the length of the section of well 20 to be treated, and the total length of the acoustic tool unit, the acoustic tool unit and the chemical injector may be moved axially along the length of well 20, so that all desired portions of well 20 and the reservoir formation nearby are subject to sonochemical treatment, either at the same time or sequentially. In this respect, cable hose 110 can be conveniently used to reposition the acoustic tool unit and the chemical injector during operation.

The sonochemical treatment of a reservoir formation may be expected to improve permeability in the volume near the perforated wellbore section of well 20. As can be appreciated by those skilled in the art, permeability may sometimes decrease due to clogging and other chemical or physical effects during normal oil production. In such cases, sonochemical treatment may be reapplied to improve productivity.

It is also noted that when a chemical agent is injected in a liquid into a non-homogeneous reservoir formation, the liquid may tend to travel through a path of least resistance, and may not be effectively dispersed if various regions in the formation are clogged or have low permeability or porosity as compared to nearby regions. However, when the same volume of formation is simultaneously stimulated with ultrasonic energy and optionally by hydraulic shock wave, the permeability and porosity in the volume may be kept more uniform during injection, allowing the fluid to be more evenly and more effectively dispersed.

To achieve better or optimal results, the sonochemical treatment may be designed and selected based on geophysical studies of the particular reservoir to be treated. To achieve desired synergetic effects, the selected chemical agents may need to be injected directly into the same zone that is under acoustic treatment. The treatment zone may be selected from, or limited to, zones that are expected or known to be problematic, so that the overall treatment time can be controlled and limited for improved effectiveness and efficiency.

The treatment may be controlled and adjusted based on the feedback and information obtained from downhole sensors or measurements, although the data may be processed and analysed at surface and control signals may be dispatched at surface. In this regard, signal wires 115 and power wires 114 in cable hose 110 may be conveniently used.

Useful information that may be obtained from a downhole tool or sensors may include temperature, pressure, and fluid flow information.

During operation, the following properties of sonotrodes 140 and shock wave tool 150 may be monitored, such as displayed at a control station at surface: capacitor voltage, discharge current, work mode (working/pausing), frequency, or the like.

During treatment, information and data may be continuously processed to better control and adjust the treatment process based on the current status and expected development.

Other geophysical downhole tools (not shown) may be used during operation and treatment. For example, such tools may be related to measurement of, downhole pressure, downhole temperature, natural radiation of the rock formation in the reservoir, downhole fluid flow, magnetic location of couplings, thermoconductive flow, electrical resistance, or soil/water content.

The effectiveness of a sonochemical treatment may be assessed by measuring fluid flow characteristics in the treated region immediately before and immediately after the treatment.

In some embodiments, the selection of equipment and downhole tools or materials to be used may be made to ensure that they are suitable for use and operation under the particular downhole conditions. For example, they may be selected for use under conditions at a temperature of up to 150 C or higher, a maximum pressure of 60 MPa, and in an acidic environment.

During or after treatment, fluids may be produced through tubing 24, or the space between tubing 24 and casing 22, such as in a conventional manner, as can be understood by those skilled in the art.

In the same or different treatment periods, different chemical agents may be used. In this regard, a cable hose with multiple fluid conduits may be provided for simultaneous injection of different chemicals to prevent pre-mixing before they injected into the wellbore. Alternatively, different chemicals may be injected sequentially through the same fluid conduit in a cable hose. Additional chemicals may also be previously injected, either through cable hose 110 or through another fluid channel in fluid communication with the perforated section of well 20.

While the particular embodiments described herein are illustrated with a horizontal well, and the described tool assemblies and processes are particularly useful for treating a horizontal well in a reservoir containing viscous hydrocarbons, it should be understood that a tool assembly or process as contemplated herein may also be applied in other wells, including inclined wells or vertical wells, and in other types of reservoirs of hydrocarbons, where fluid mobility and blockage of fluid flow near or at a perforated wellbore section may likely occur.

In different embodiments, when both production wells and injection wells are used, both types of wells may be treated as described herein.

Other features, modifications, and applications of the embodiments described here may be understood by those skilled in the art in view of the disclosure herein.

It is noted that test results show that sonochemical treatment of a hydrocarbon formation performed better than treating the same formation with ultrasonic stimulation only. In some tests conducted, a one meter thick formation material was subjected to ultrasonic treatment for one hour. In comparison, the same formation material was subjected to sonochemical treatment for about 30 min. Field tests in vertical wells were also conducted. It was shown that sonochemical treatment can improve oil production in vertical wells and the effects of treatment remained for longer than using ultrasonic treatment alone. It was expected that these improvements at least in part resulted from removal of clogging or blockage from the pores by the sonochemical treatment, including opening of very small pores. It was expected that under the influence of ultrasound the injected chemicals could penetrate into the very small pores. Thus, the combined treatment provided improved results, as compared to using ultrasound or chemical treatment separately, even though the treatment time for the sonochemical treatment was reduced by half as compared to the treatment time for ultrasonic treatment alone.

Typically, ultrasonic and sonochemical treatment of a well may be performed during production "down-time". Conventional down-time is often accompanied by optimization of the pumping equipment. In order to differentiate between the effects of ultrasound and normal workover we have measured the influence of ultrasonic treatment and workover on the changes in the productivity factor of the oil well and water cut i.e. the percentage of water in the recovered well fluid. Ultrasonic treatment leads to an increase of the productivity factor by 39% and decrease of the water cut of the well by 5% on average. Whereas in wells where only the optimization of pumping equipment was carried out there was a drop in the productivity factor of 5.6% and an increase in the water cut of 1.5%. The tests indicated that the success rate of the ultrasonic treatment of vertical wells reaches 90% and the increase in oil production is in the range of 40 to 100%.

Tests of sonochemical treatment were also conducted in horizontal wells. A 1 m thick formation was subjected to ultrasonic treatment after injection of a chemical reagent for 15 min. Before and after sonochemical treatment of the well, geophysical studies of the well were carried out. Based on the information received the zones for sonochemical treatment were determined. The treated area was 200 to 300 meter long, the productive formation had a porosity of 0.27, the permeability was 0.515 $\mu m^2$ and oil saturation was 0.67.

As a result of sonochemical treatment the production of fluid and production of oil from all three treated wells grew. On average the production of fluid increased from 51 to 72 tons per day, and the production of oil from 23 to 33 tons per day. In comparison with the sonochemical treatment of vertical wells in the same region the treatment of horizontal wells improved oil production but to a less extent as compared to similar treatment of vertical wells, and the reduction in water use after treatment was negligible.

Chemical reagents that have been used for test treatment of horizontal wells include acids, oxidants, enzymes and chelates. Potentially all of these reagents and others may be used for sonochemical treatment of wells or reservoir formation.

Experimental results and theoretical estimations both show that the optimal treatment time of ultrasonic enhanced oil recovery (EOR) in vertical wells may be about 60 min. However, in case of sonochemical treatment for horizontal wells the optimal treatment time may be reduced. Laboratory experiments have shown that ultrasound can enhance the effect of chemicals used to improve the performance of vertical wells and to treat the wellbore perforation zone of horizontal wells.

In an embodiment, a chemical agent and acoustic energy are co-injected, through a horizontal well, into a selected zone or volume of the reservoir proximate the horizontal well, such that the chemical agent and acoustic energy are dispersed into the selected zone/volume simultaneously. In other words, the chemical agent and acoustic energy are dispersed in the zone/volume, in both spatial and temporal proximity.

In an embodiment, an ultrasonic wave may be transmitted into the selected zone/volume through a perforated section of the horizontal well, and the chemical agent may be injected into the selected volume through the same perforated section while the ultrasonic wave is propagating in the selected volume. The perforated section may be selected from a plurality of perforated sections of the horizontal well, and the chemical agent may be selected to improve mobility of hydrocarbons within the reservoir.

In another aspect, the present disclosure relates to a downhole tool for co-injection of a chemical agent and acoustic energy into a reservoir of viscous hydrocarbons in both spatial and temporal proximity.

In this disclosure, the terms "oil", "hydrocarbons" or "hydrocarbon" relate to mixtures of varying compositions comprising hydrocarbons in the gaseous, liquid or solid states, which may be in combination with other fluids (liquids and gases) that are not hydrocarbons. For example, oil or hydrocarbons may include what are known as "light oil", "heavy oil", "extra heavy oil", or "bitumen". Viscous hydrocarbons refer to hydrocarbons occurring in semi-solid or solid form and having a viscosity in the range of about 1,000 to over 1,000,000 centipoise (mPa·s or cP) measured at original in-situ reservoir temperature. Depending on the in-situ density and viscosity of the hydrocarbons, the hydrocarbons may comprise, for example, a combination of light oil, heavy oil, extra heavy oil and bitumen. Heavy crude oil, for example, may be defined as any liquid petroleum hydrocarbon having an American Petroleum Institute (API) Gravity of less than about 20° and a viscosity greater than 1,000 mPa·s. Oil may be defined, for example, as hydrocarbons mobile at typical reservoir conditions. Extra heavy oil, for example, may be defined as having a viscosity of over 10,000 mPa·s and about 10° API Gravity. The API Gravity of bitumen ranges from about 12° to about 7° and the viscosity is greater than about 1,000,000 mPa·s. Native bitumen is generally non-mobile at typical native reservoir conditions.

A person skilled in the art will appreciate that in some reservoirs, either before or during oil production, fluid flow might be impeded by various factors such as low porosity, high viscosity of fluids, or the like. In some cases, at initial (or original) reservoir conditions (e.g., temperature or viscosity), before a reservoir has been treated with a chemical agent, heat, acoustic energy, or other means, the reservoir formation may have limited fluid mobility. In some cases, the fluid mobility in a reservoir may decrease after a period of oil production. In either of these cases, sonochemical treatment of the formation through a well according to an embodiment of the present disclosure may conveniently increase fluid mobility in the formation.

Hydrocarbons in a reservoir of bituminous sands may be in a complex mixture comprising interactions between sand particles, fines (e.g., clay), and water (e.g., interstitial water) which may form complex emulsions during processing. The hydrocarbons derived from bituminous sands may contain other contaminant inorganic, organic or organometallic species which may be dissolved, dispersed or bound within suspended solid or liquid material. It remains challenging to separate hydrocarbons from the bituminous sands in-situ, which may impede production performance of the in-situ process. Sonochemical treatment of such a reservoir may improve production performance.

Production performance may be improved when a higher amount of oil is produced within a given period of time, or in some other manner as can be understood by those skilled in the art. For example, production performance may be improved by increasing flow rate of fluid from the reservoir into a production well, or the flow rate of fluid from an injection well into the reservoir, or both.

Faster fluid flow in regions near a well and through perforations of the well can lead to more efficient oil production, and the increase in the flow rate can be indirectly indicated or measured by the increase in the rate of fluid production or oil production to the surface. The well may be a production well, or an injection well. In the latter case, improved fluid flow in or near the injection well may be detected by monitoring production rates at a production well in fluid communication with the injection well. Techniques for measurement of production rates have been well developed and are known to those skilled in the art.

CONCLUDING REMARKS

It will be understood that any range of values herein is intended to specifically include any intermediate value or sub-range within the given range, and all such intermediate values and sub-ranges are individually and specifically disclosed.

It will also be understood that the word "a" or "an" is intended to mean "one or more" or "at least one", and any singular form is intended to include plurals herein.

It will be further understood that the term "comprise", including any variation thereof, is intended to be open-ended and means "include, but not limited to," unless otherwise specifically indicated to the contrary.

When a list of items is given herein with an "or" before the last item, any one of the listed items or any suitable combination of two or more of the listed items may be selected and used.

Of course, the above described embodiments of the present disclosure are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A method comprising:

simultaneously injecting a chemical agent, through an injector, into a perforated wellbore section of a well casing of a well in a hydrocarbon reservoir, and generating an acoustic wave with an acoustic tool positioned in the perforated wellbore section of the well casing, while the injector and acoustic tool are moved back and forth continuously in synchronization, wherein the acoustic tool comprises a sonotrode for generating the acoustic wave, and the acoustic wave comprises a radially propagating ultrasonic wave, stimulating the perforated wellbore section of the well casing with the radially propagating ultrasonic wave, and reducing clogging or blockage of perforations in the well casing by moving the injector and acoustic tool back and forth continuously in synchronization.

2. The method of claim 1, wherein the acoustic tool comprises more than one sonotrode.

3. The method of claim 1, wherein the acoustic tool comprises one or more shock wave tools for generating a hydraulic shock wave.

4. The method of claim 1, further comprising, applying a cyclic fluid pressure in the perforated wellbore section of the well.

5. The method of claim 1, wherein the injector and the acoustic tool are connected to a cable hose for moving the injector and acoustic tool to and fro in synchronization, the cable hose comprising a wire for supplying power to the acoustic tool and having a conduit for supplying the chemical agent to the injector.

6. The method of claim 5, wherein the cable hose comprises an armored cable body defining the conduit.

7. The method of claim 5, wherein the cable hose further comprises a signal wire for transmitting a signal therethrough.

8. The method of claim 1, wherein the well is a horizontal well.

9. The method of claim 8, wherein the acoustic tool generates a radially propagating acoustic wave.

10. The method of claim 1, wherein the chemical agent comprises an oxidant, enzyme, chelate, solvent, surfactant, diluting liquid, detergent, wetting agent, emulsifier, foaming agent, dispersant, or a combination thereof.

11. A downhole tool assembly comprising:

an injector positioned in a well casing of a well penetrating a hydrocarbon reservoir, for injecting a chemical agent into a perforated wellbore portion of the well casing;

an acoustic tool positioned in the perforated wellbore portion of the well casing for generating an acoustic wave, the acoustic tool comprising a sonotrode for generating the acoustic wave, and the acoustic wave comprising a radially propagating ultrasonic wave; and a movable cable hose connected to the injector and the acoustic tool for moving the injector and acoustic tool back and forth continuously in synchronization, the cable hose comprising a wire for supplying power to the acoustic tool and having a conduit for supplying the chemical agent to the injectors;

wherein the radially propagating ultrasonic wave stimulates the perforated wellbore section of the well casing, and moving the injector and acoustic tool back and forth continuously in synchronization reduces clogging or blockage of perforations in the well casing.

12. The tool assembly of claim 11, wherein the acoustic tool comprises more than one sonotrode.

13. The tool assembly of claim 11, wherein the acoustic tool comprises one or more shock wave tools for generating a hydraulic shock wave.

14. The tool assembly of claim 11, wherein the cable hose comprises an armored cable body defining the conduit.

15. The tool assembly of claim 11, wherein the cable hose further comprises a signal wire for transmitting a signal therethrough.

16. The tool assembly of claim 11, wherein the sonotrode has an oscillation frequency from 10 to 50 kHz.

17. The tool assembly of claim 11, wherein the sonotrode comprises a tubular housing defining a cavity, an electroacoustic transducer and cooling oil disposed in the cavity, and a pressure compensator.

18. The tool assembly of claim 11, comprising a plurality of sonotrodes each having a distinct resonance frequency, wherein the resonance frequencies of the sonotrodes differ from one another by at least 1 kHz.

19. The tool assembly of claim 11, further comprising a jet pump disposed in the well for reducing a fluid pressure in the perforated wellbore section of the well, the jet pump having a channel for receiving the cable hose to allow the cable hose to pass through the jet pump, the jet pump comprising a pressure-actuated sealing device mounted in the channel for sealing around the cable hose.

20. The tool assembly of claim 19, wherein the sealing device comprises two ring members connected by a plurality of separated panels, wherein under pressure the panels are bendable inwardly to abut one another so as to form a seal.

21. The tool assembly of claim 11, comprising a flexible connector connecting the acoustic tool to the injector.

22. The tool assembly of claim 11, wherein the injector and the cable hose are configured for injecting an oxidant, enzyme, chelate, solvent, surfactant, diluting liquid, detergent, wetting agent, emulsifier, foaming agent, dispersant, or a combination thereof.

* * * * *